US011015878B2

(12) United States Patent
Alahyari et al.

(10) Patent No.: US 11,015,878 B2
(45) Date of Patent: May 25, 2021

(54) HEAT TRANSFER TUBE FOR HEAT EXCHANGER

(71) Applicant: Carrier Corporation, Palm Beach Gardens, FL (US)

(72) Inventors: Abbas A. Alahyari, Manchester, CT (US); Miad Yazdani, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/063,060

(22) PCT Filed: Dec. 9, 2016

(86) PCT No.: PCT/US2016/065730
§ 371 (c)(1),
(2) Date: Jun. 15, 2018

(87) PCT Pub. No.: WO2017/106024
PCT Pub. Date: Jun. 22, 2017

(65) Prior Publication Data

US 2018/0372426 A1 Dec. 27, 2018

Related U.S. Application Data

(60) Provisional application No. 62/268,047, filed on Dec. 16, 2015.

(51) Int. Cl.
*F28F 1/12* (2006.01)
*F28F 13/18* (2006.01)
(Continued)

(52) U.S. Cl.
CPC ..... *F28F 1/12* (2013.01); *F28D 7/1653* (2013.01); *F28D 15/046* (2013.01);
(Continued)

(58) Field of Classification Search
CPC ..... F28F 13/187; F28F 1/12; F28F 2245/00; F28D 15/046
See application file for complete search history.

(56) References Cited

U.S. PATENT DOCUMENTS 3,598,180 A * 8/1971 Moore, Jr. ..... F28D 15/046 165/133
4,182,412 A * 1/1980 Shum ..... F28F 13/187 165/133
(Continued)

FOREIGN PATENT DOCUMENTS

CN 87200656 U 5/1988
CN 1969382 A 5/2007
(Continued)

OTHER PUBLICATIONS

Description CN102401598 machine translation (Year: 2012).*
(Continued)

*Primary Examiner* — Gordon A Jones
(74) *Attorney, Agent, or Firm* — Cantor Colburn LLP

(57) ABSTRACT

A thermal energy exchange tube for a heat exchanger includes a tube inner surface and a tube outer surface radially offset from the tube inner surface. The tube outer surface includes patterned porosity with a plurality of high porosity regions of the tube outer surface having relatively high porosity to promote flow of fluid radially inwardly via capillary flow, and a plurality of low porosity regions of the tube outer surface having relatively low porosity to facilitate vapor departure from the tube outer surface.

7 Claims, 6 Drawing Sheets

(51) Int. Cl.
*F28D 7/16* (2006.01)
*F28D 15/04* (2006.01)

(52) U.S. Cl.
CPC ..... *F28F 13/187* (2013.01); *F28F 2245/00* (2013.01); *F28F 2255/18* (2013.01); *F28F 2265/02* (2013.01); *F28F 2275/04* (2013.01)

(56) References Cited

U.S. PATENT DOCUMENTS

| | | | | | |
|---|---|---|---|---|---|
| 4,425,696 | A | | 1/1984 | Torniainen | |
| 4,577,381 | A | | 3/1986 | Sato et al. | |
| 4,663,243 | A | | 5/1987 | Czikk et al. | |
| 4,765,058 | A | | 8/1988 | Zohler | |
| 5,070,937 | A | | 12/1991 | Mougin et al. | |
| 5,333,682 | A | * | 8/1994 | Liu | F28F 1/26 165/133 |
| 5,351,397 | A | | 10/1994 | Angeli | |
| 5,669,441 | A | | 9/1997 | Spencer | |
| 5,697,430 | A | * | 12/1997 | Thors | F28F 1/36 165/133 |
| 5,832,995 | A | * | 11/1998 | Chiang | F28F 1/26 165/179 |
| 5,996,686 | A | * | 12/1999 | Thors | F28F 1/422 165/133 |
| 6,216,343 | B1 | | 4/2001 | Leland et al. | |
| 6,382,311 | B1 | * | 5/2002 | Mougin | F28F 1/42 165/133 |
| 6,644,388 | B1 | | 11/2003 | Kilmer et al. | |
| 6,736,204 | B2 | | 5/2004 | Gollan et al. | |
| 6,994,151 | B2 | | 2/2006 | Zhou et al. | |
| 7,237,337 | B2 | | 7/2007 | Yeh et al. | |
| 2003/0136547 | A1 | * | 7/2003 | Gollan | F28F 13/187 165/104.21 |
| 2005/0022976 | A1 | | 2/2005 | Rosenfeld et al. | |
| 2005/0280996 | A1 | | 12/2005 | Erturk et al. | |
| 2007/0193728 | A1 | * | 8/2007 | Beutler | B21C 37/207 165/133 |
| 2011/0203777 | A1 | | 8/2011 | Zhao et al. | |
| 2014/0311182 | A1 | * | 10/2014 | Christians | F25B 39/028 62/515 |

FOREIGN PATENT DOCUMENTS

| | | | | | |
|---|---|---|---|---|---|
| CN | 101498563 | A | | 8/2009 | |
| CN | 202153112 | U | | 2/2012 | |
| CN | 102401598 | A | | 4/2012 | |
| CN | 103822519 | A | | 5/2014 | |
| JP | 62106292 | A | * | 5/1987 | F28D 5/02 |
| JP | 0771889 | A | | 3/1995 | |

OTHER PUBLICATIONS

JP 62106292 A abs mt (Year: 1987).*

Liter, et al., "Pool-boiling CHF enhancement by modulated porous-layer coating: theory and experiment", XP-002347671, International Journal of Heat and Mass Transfer 44 (2001) pp. 4287-4311, Jan. 12, 2001, Pergamon, Elsevier Science Ltd.

Nakayama, "Effects of Pore Diameters and System Pressure on Saturated Pool Nucleate Boiling Heat Transfer From Porous Surfaces", J. Heat Transfer 104(2), 286-291 (May 1, 1982) (6 pages), Received Sep. 29, 1981; Online Oct. 20, 2009, ASME.

Nakayama, "Enhancement of heat transfer", In: Heat transfer 1982; Proceedings of the Seventh International Conference, Munich, West Germany, Sep. 6-10, 1982. vol. 1 (A83-42651 20-34). Washington, DC, Hemisphere Publishing Corp., 1982, p. 223-240.

Nakayama, et al., "Dynamic Model of Enhanced Boiling Heat Transfer on Porous Surfaces—Part I: Experimental Investigation", The American Society of Mechanical Engineers, J. Heat Transfer 102(3), 445-450 (Aug. 1, 1980) (6 pages), Received Nov. 9, 1979; Online Oct. 20, 2009, ASME. doi:10.1115/1.3244320.

Webb, "The Evolution of Enhanced Surface Geometries for Nucleate Boiling", Heat Transfer Engineering, vol. 2, 1981—Issue 3-4, pp. 46-69 | Published online: May 21, 2007, Taylor & Francis Online. https://doi.org/10.1080/01457638108962760.

International Search Report for International Application No. PCT/US2016/065730; International Filing Date Dec. 9, 2016; dated Mar. 2, 2017; 6 Pages.

Written Opinion for International Application No. PCT/US2016/065730; International Filing Date Dec. 9, 2016; dated Mar. 2, 2017; 8 Pages.

Chinese Office Action Issued in CN Application No. 201680073800.3, dated Sep. 4, 2019, 28 Pages.

* cited by examiner

HEAT TRANSFER TUBE FOR HEAT EXCHANGER

CROSS REFERENCE TO RELATED APPLICATIONS

This application is a National Stage application of PCT/US2016/065730, filed Dec. 9, 2016, which claims the benefit of U.S. Provisional Application No. 62/268,047, filed Dec. 16, 2015, both of which are incorporated by reference in their entirety herein.

BACKGROUND

The subject matter disclosed herein relates to heating, ventilation, air conditioning and refrigeration (HVAC/R) systems. More specifically, the subject matter disclosed herein relates to heat transfer tubes for heat exchangers of HVAC/R systems.

HVAC/R systems, such as chillers, use an evaporator to facilitate a thermal energy exchange between a refrigerant in the evaporator and a medium flowing in a number of evaporator tubes positioned in the evaporator. In the evaporator, tubes circulate a heat exchange medium, such as water or a brine solution through the evaporator. Exterior surfaces of the tubes contact a flow of refrigerant, and thermal energy exchange between the relatively low temperature refrigerant and the relatively high temperature heat exchange medium results in boiling of the refrigerant.

BRIEF SUMMARY

In one embodiment, a thermal energy exchange tube for a heat exchanger includes a tube inner surface and a tube outer surface radially offset from the tube inner surface. The tube outer surface includes patterned porosity with a plurality of high porosity regions of the tube outer surface having relatively high porosity to promote flow of fluid radially inwardly via capillary flow, and a plurality of low porosity regions of the tube outer surface having relatively low porosity to facilitate vapor departure from the tube outer surface.

Additionally or alternatively, in this or other embodiments the low porosity regions are defined by spaces between adjacent high porosity regions.

Additionally or alternatively, in this or other embodiments a high porosity region of the plurality of high porosity region has a triangular cross-sectional shape.

Additionally or alternatively, in this or other embodiments a ratio of an axial length of a high porosity region along a tube axis to a radial height of the high porosity region is between about 0.1 and 10.0.

Additionally or alternatively, in this or other embodiments the plurality of high porosity regions and the plurality of low porosity regions are arranged in a plurality of rows along a tube axis, a circumferential center of each high porosity region in a first row located circumferential offset from a circumferential center of each high porosity region of an axially adjacent second row.

Additionally or alternatively, in this or other embodiments a porous cover layer is positioned over the plurality of high porosity regions and the plurality of low porosity regions.

Additionally or alternatively, in this or other embodiments the porous cover layer includes a plurality of cover layer segments with an axial cover layer gap between axially adjacent cover layer segments.

Additionally or alternatively, in this or other embodiments the plurality of high porosity regions are formed from a plurality of microspheres.

Additionally or alternatively, in this or other embodiments the plurality of high porosity regions are formed through metallic or nonmetallic coatings and/or via mechanical forming.

Additionally or alternatively, in this or other embodiments the plurality of high porosity regions are formed through one or more of sintering, brazing, electrodeposition or via selective chemical etching of the thermal energy exchange tube.

In another embodiment, a heat exchanger for a heating ventilation, air conditioning and refrigeration system includes a heat exchanger housing and a plurality of heat exchanger tubes extending through the heat exchanger housing, the plurality of heat exchanger tubes conveying a first fluid therethrough for thermal energy exchange with a second fluid outside of the plurality of heat exchanger tubes. Each heat exchanger tube of the plurality of heat exchanger tubes includes a tube inner surface and a tube outer surface radially offset from the tube inner surface. The tube outer surface includes patterned porosity with a plurality of high porosity regions of the tube outer surface having relatively high porosity to promote flow of the second fluid radially inwardly via capillary flow, and a plurality of low porosity regions of the tube outer surface having relatively low porosity to facilitate vapor departure from the tube outer surface.

Additionally or alternatively, in this or other embodiments the low porosity regions are defined by spaces between adjacent high porosity regions.

Additionally or alternatively, in this or other embodiments a high porosity region of the plurality of high porosity region has a triangular cross-sectional shape.

Additionally or alternatively, in this or other embodiments a ratio of an axial length of a high porosity region along a tube axis to a radial height of the high porosity region is between about 0.1 and 10.0.

Additionally or alternatively, in this or other embodiments the plurality of high porosity regions and the plurality of low porosity regions are arranged in a plurality of rows along a tube axis, a circumferential center of each high porosity region in a first row located circumferential offset from a circumferential center of each high porosity region of an axially adjacent second row.

Additionally or alternatively, in this or other embodiments a porous cover layer is positioned over the plurality of high porosity regions and the plurality of low porosity regions.

Additionally or alternatively, in this or other embodiments the porous cover layer includes a plurality of cover layer segments with an axial cover layer gap between axially adjacent cover layer segments.

Additionally or alternatively, in this or other embodiments the plurality of high porosity regions are formed from a plurality of microspheres.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

Figure 1:
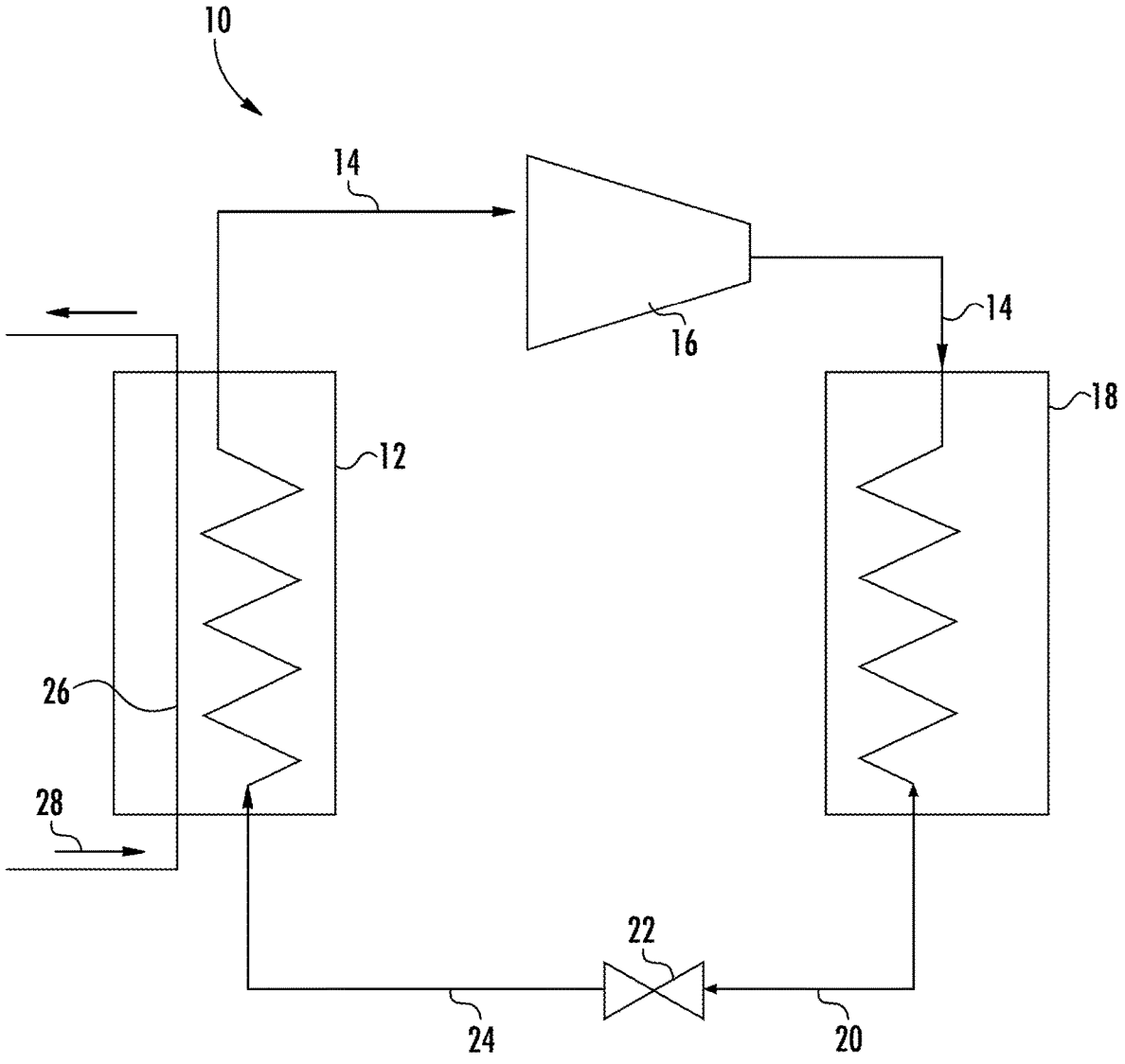
FIG. 1 is a schematic view of an embodiment of a heating, ventilation, air conditioning and refrigeration (HVAC/R) system.

The detailed description explains embodiments of the invention, together with advantages and features, by way of example with reference to the drawing.

DETAILED DESCRIPTION

To enhance heat transfer properties of the tubes, the outer surfaces of the tubes can include various types of microstructures. The surfaces typically include reentrant cavities formed by forming of fins on the tube surface, then flattening the fins. The resulting structures appear as micropores on the surface linked by an array of subsurface cavities.

Shown in FIG. 1 is a schematic view of an embodiment of a vapor compression cycle having an evaporator, condenser, compressor, interconnections, and an expansion device. In an embodiment, the cycle can be used in a heating, ventilation, air conditioning and refrigeration (HVAC/R) system, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
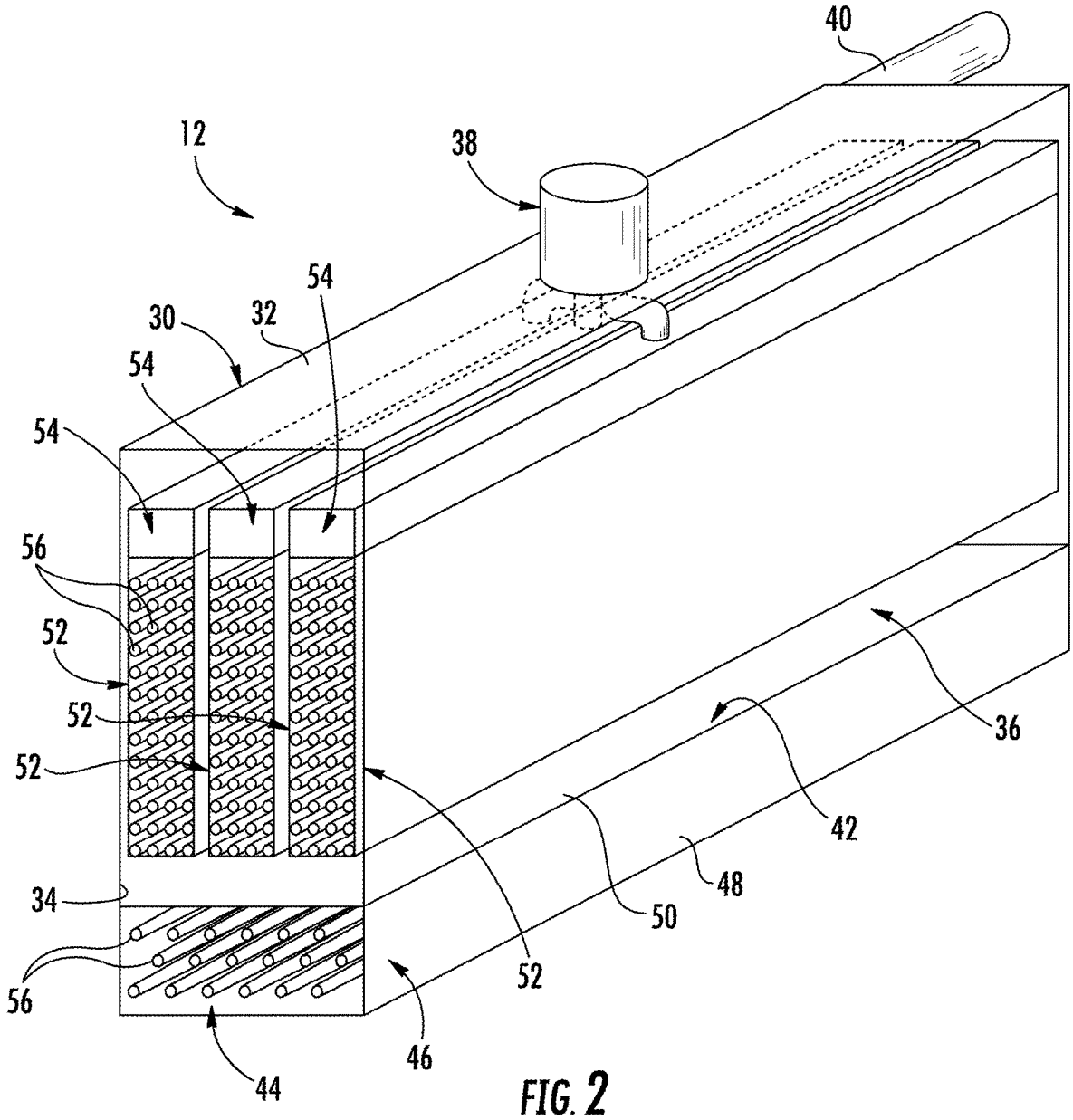
FIG. 2 is a schematic view of an embodiment of an evaporator for an HVAC/R system.

Referring now to FIG. 2, as stated above, the evaporator 12 is a falling film evaporator. The evaporator 12 includes a shell 30 having an outer surface 32 and an inner surface 34 that define a heat exchange zone 36. In an exemplary embodiment shown, shell 30 includes a non-circular cross-section. As shown, shell 30 includes a rectangular cross-section however, it should be understood that shell 30 can take on a variety of forms including both circular and non-circular. Shell 30 includes a refrigerant inlet 38 that is configured to receive a source of refrigerant (not shown). Shell 30 also includes a vapor outlet 40 that is configured to connect to an external device such as the compressor 16. Evaporator 12 is also shown to include a refrigerant pool zone 42 arranged in a lower portion of shell 30. Refrigerant pool zone 14 includes a pool tube bundle 44 that circulates a fluid through a pool of refrigerant 46. Pool of refrigerant 46 includes an amount of liquid refrigerant 48 having an upper surface 50. The fluid circulating through the pool tube bundle 44 exchanges heat with pool of refrigerant 46 to convert the amount of refrigerant 48 from a liquid to a vapor state. In this embodiment, evaporator 12 includes a plurality of tube bundles 52 that provide a heat exchange interface between refrigerant and another fluid. Each tube bundle 52 may include a corresponding refrigerant distributor 54. Refrigerant distributors 54 provide a uniform distribution of refrigerant onto tube bundles 52 respectively. While the description herein is in the context of a falling film evaporator 12, it is to be appreciated that the subject disclose may readily be applied to other types of evaporators, such as a flooded evaporator, and further to other types of heat exchangers where tubes are utilized in thermal energy exchange between a first fluid flowing through the tube and a second fluid flowing outside of the tube.

Figure 3:
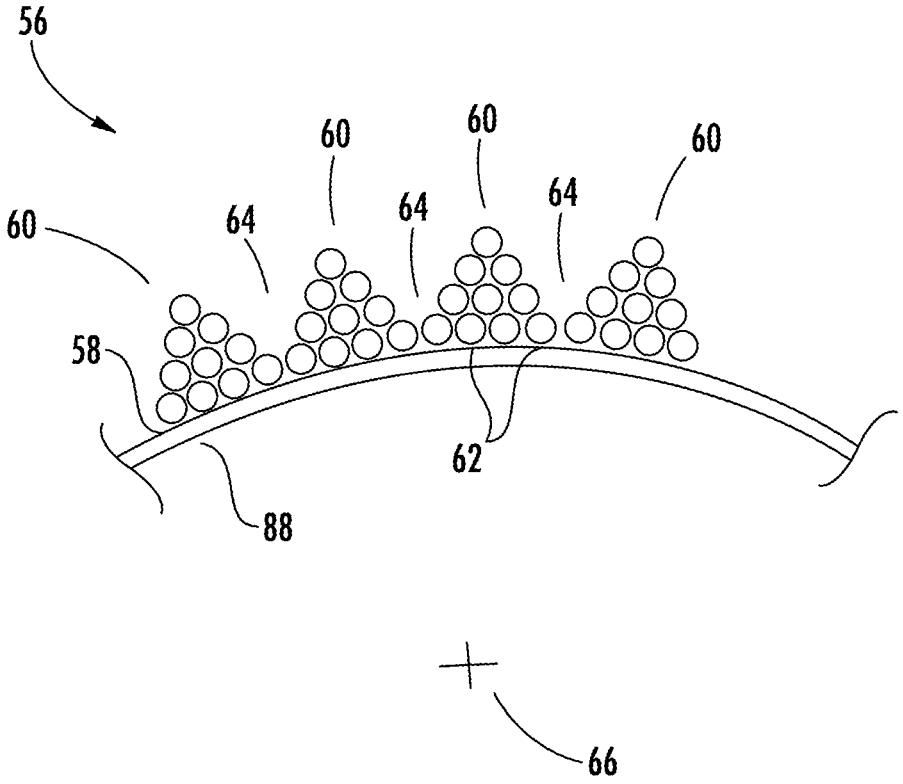
FIG. 3 is a cross-sectional view of an embodiment of an outer surface of a tube for a heat exchanger.

Pool tube bundle 44 and tube bundle 52 include a plurality of heat exchange tubes 56. Referring to the partial cross-section of FIG. 3, the heat exchange tubes include a tube outer surface 58 at a radial distance from a tube axis 66, and a tube inner surface 88 radially offset from the tube outer surface 58. The tube outer surface 58 has a patterned porosity with regions of the tube outer surface 58 having relatively high porosity, and regions having relatively low porosity. The regions of high porosity facilitate the flow of fluid, in this case refrigerant, radially inwardly into the tube outer surface 58 via capillary flow, for thermal energy exchange with the fluid flowing through the heat exchange tubes 56. The refrigerant is boiled via the thermal energy exchange, and the regions of low porosity facilitate refrigerant vapor departure from the tube outer surface 58. The high porosity regions 60 may be formed from a plurality of microspheres 62, with the porosity resulting from gaps between adjacent microspheres 62. The low porosity regions 64 are formed by spacing between adjacent high porosity regions 60. The microspheres 62 may be arranged in a variety of cross-sectional shapes to provide a desired degree of porosity, such as the shown triangular cross-section, or alternatively rectangular or other shapes. The microspheres 62 may be formed from the same material as the heat exchange tubes 56, or alternatively may be formed from a different material than the heat exchange tubes 56, depending on the desired heat transfer properties. Example materials for the heat exchange tubes 56 and/or the microspheres 62 include, but are not limited to, copper, aluminum or plastic materials. It is to be appreciated that, while in the description above, the high porosity regions 60 are formed from microspheres 62, in other embodiments the high porosity regions 60 may be additionally or alternatively formed via metallic or nonmetallic coatings, mechanical forming or through processes such as sintering, brazing or electrodeposition. Further, in other embodiments, the high porosity regions 60 and the low porosity regions 64 may be formed via selectively chemically etching of the heat exchanger tube 56.

Figure 4:
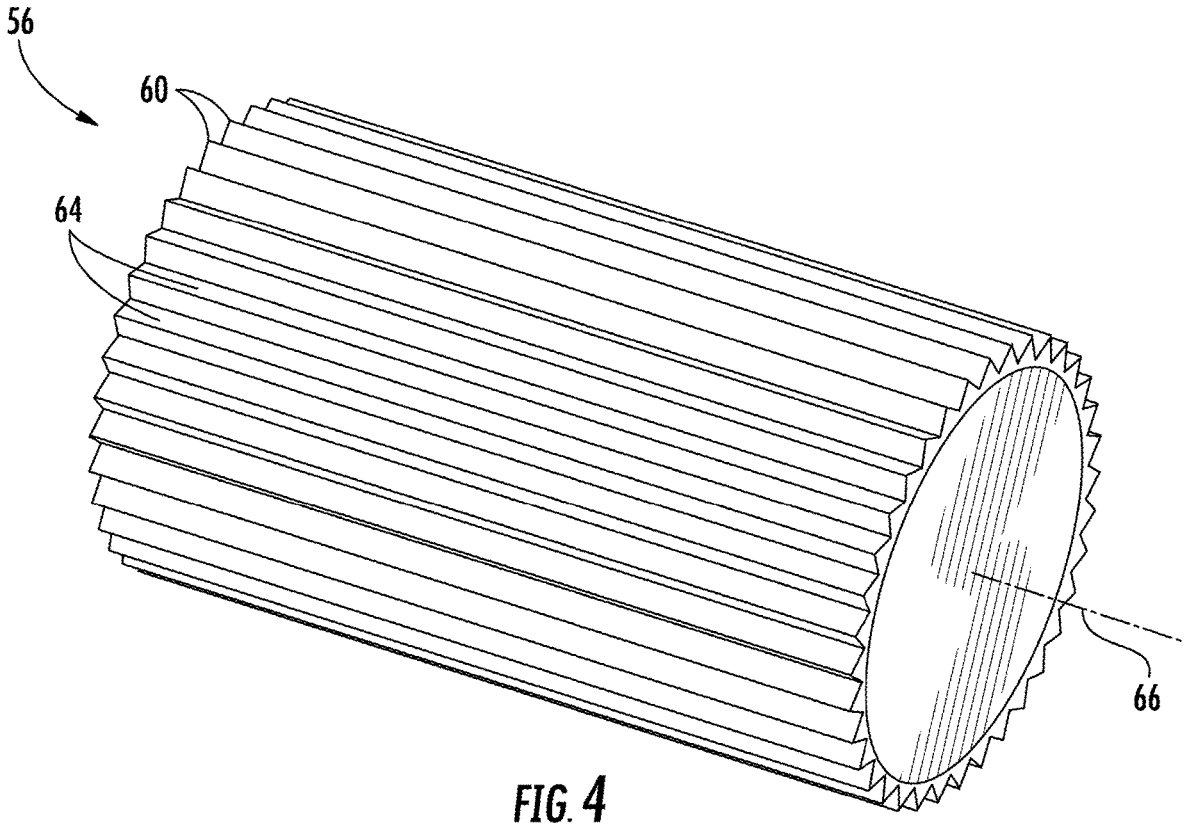
FIG. 4 is a perspective view of an embodiment of a heat exchanger tube.
Figure 5:
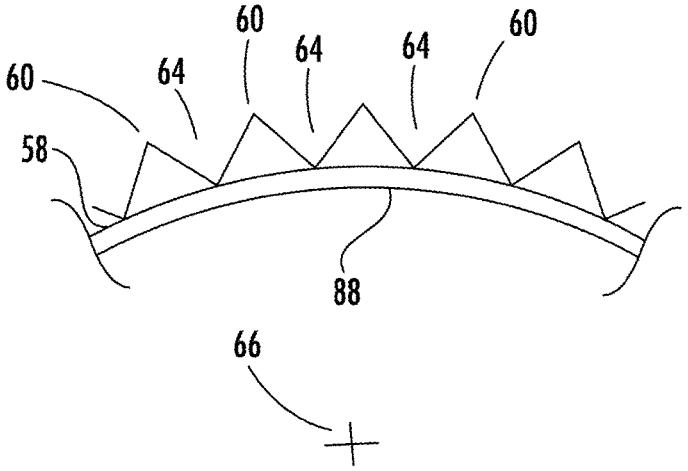
FIG. 5 is a cross-sectional view of an embodiment of a heat exchanger tube.

Shown in FIGS. 4-8 are examples of embodiments of heat exchange tubes 56 including high porosity regions 60 arrayed with low porosity regions 64. In the embodiment of FIG. 4, the tube axis 66 extends lengthwise along the heat exchange tube 56 and defining a center of the heat exchange tube 56. Referring to FIG. 5, high porosity regions 60 have triangular cross-sections and, as shown in FIG. 4 extend continuously along the tube axis 66. Low porosity regions 64 are defined between adjacent high porosity regions 60, and also extend continuously along the tube axis 66. In other embodiments, other cross-sectional shapes of high porosity regions 60 may be utilized, and further the cross-sectional shape of the high porosity regions 60 may be varied along an axial direction and/or a circumferential direction to obtain selected thermal transfer properties. Further, one skilled in the art will readily appreciate that while high porosity regions 60 and low porosity regions 64 are shown on the tube outer surface 58, these features may additionally or alternatively be applied to the tube inner surface 88.

Figure 6:
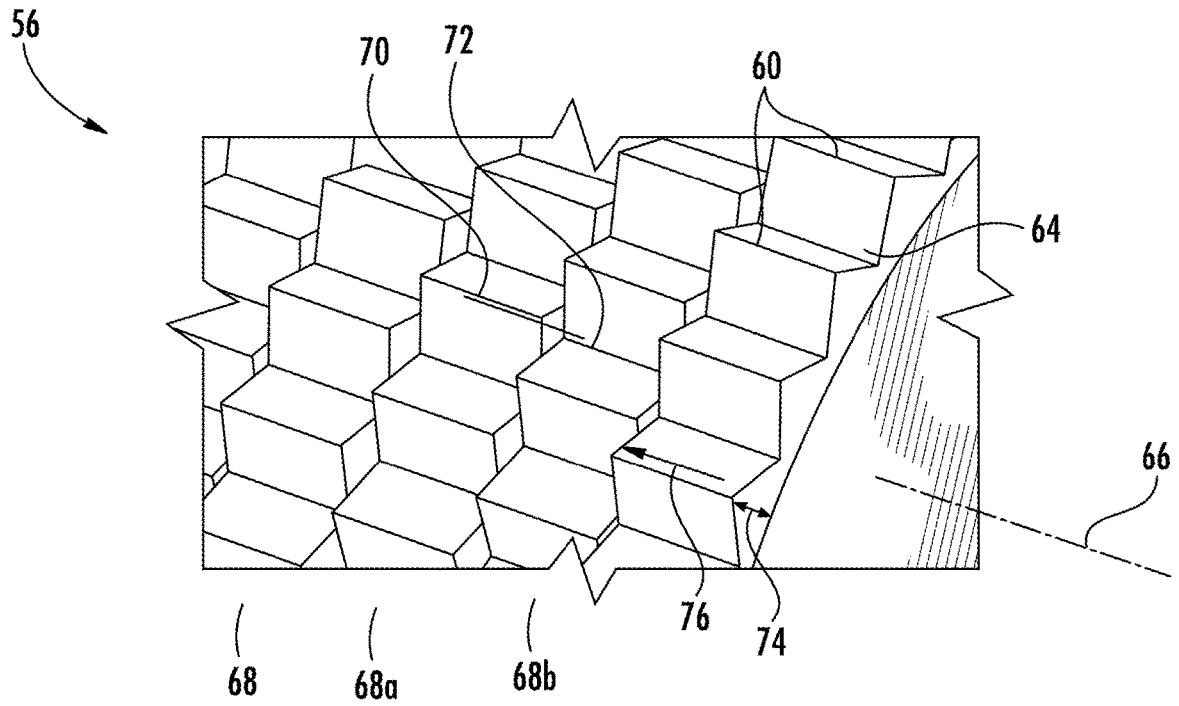
FIG. 6 is partial cross-sectional view of another embodiment of a heat exchanger tube.

FIG. 6 illustrates an arrangement of high porosity regions 60 and low porosity regions 64 that is circumferentially staggered along the tube axis 66. The high porosity regions 60 and low porosity regions 64 are arranged as a plurality of rows 68 along a length of the heat exchange tube 56. In some embodiments, a peak 70 or circumferential center of each high porosity region 60 in a first row 68*a* is located at a valley 72 or circumferential center of a low porosity region 64 of an axially adjacent second row 68*b*. It is to be appreciated that other degrees of stagger of the rows 68 are contemplated by the present disclosure. In some embodiments, each high porosity region 60 has a radial height 74 and an axial length 76, with the radial height 74 in the range of 0.1 millimeters to 2.0 millimeters. A ratio of axial length 76 to radial height 74 is in the range of 0.1 to 10.0. While in the embodiment of FIG. 6, the high porosity regions 60 and low porosity regions 64 are aligned along the tube axis 66, in other embodiments the high porosity regions 60 and the low porosity regions 64 may be angularly skewed relative to the tube axis 66 (wherein one or more high porosity peaks, shown at 60, can be arranged non-parallel with one another and/or the tube axis 66).

Figure 7:
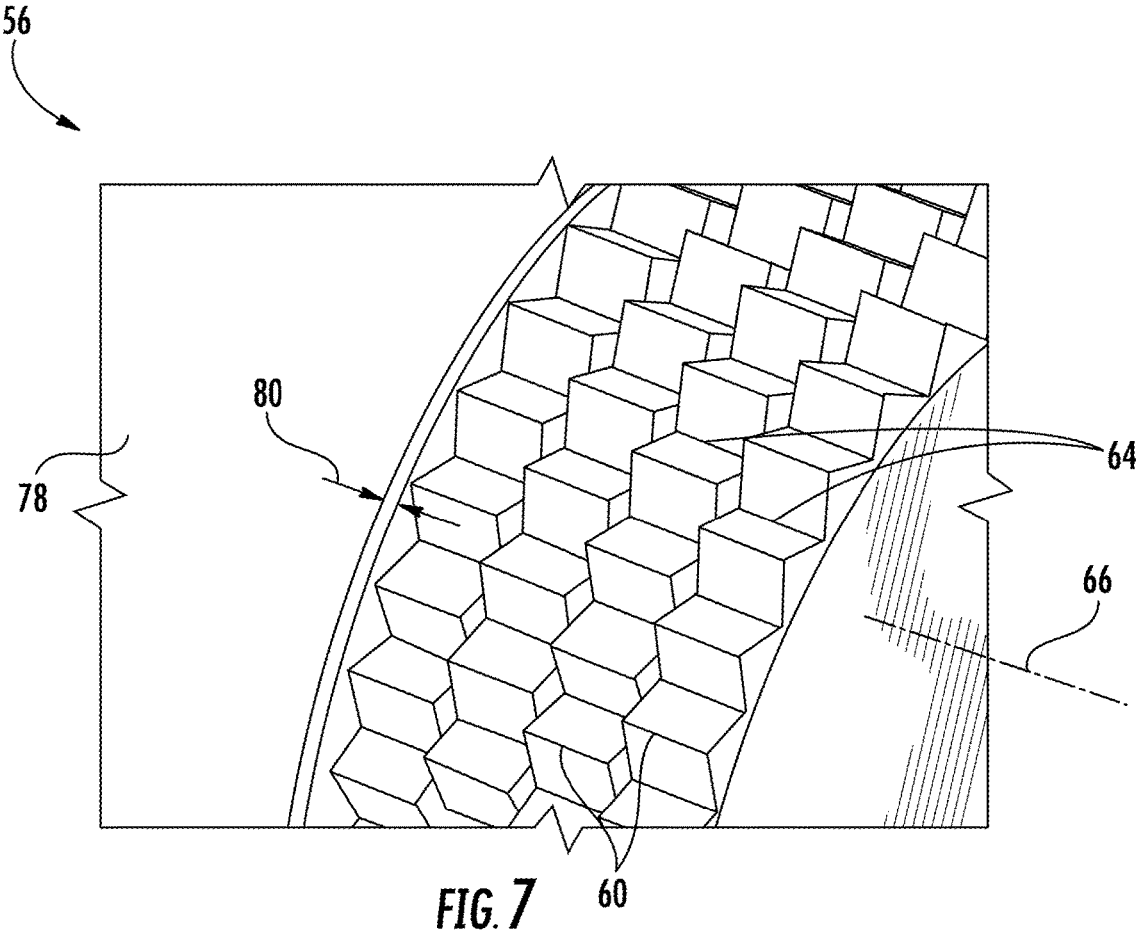
FIG. 7 is a partial cross-sectional view of yet another embodiment of a heat exchanger tube.

In some embodiments, such as shown in FIG. 7, the arrangement of high porosity regions 60 and low porosity regions 64 is enveloped in a porous cover layer 78. This further increases wicking of liquid refrigerant toward the tube outer surface 58, improving thermal exchange between the refrigerant outside the heat exchange tube 56 with the fluid inside the heat exchange tube 56. In some embodiments, the porous cover layer 78 has a cover layer thickness 80 in the range of about 0.1 millimeters to 2.0 millimeters. It is to be appreciated that while the porous cover layer 78 illustrated has a substantially constant cover layer thickness 80, in some embodiments the cover layer thickness 80 may be varied along an axial direction and/or along a circumferential direction to achieve the selected thermal and/or mass exchange properties.

Figure 8:
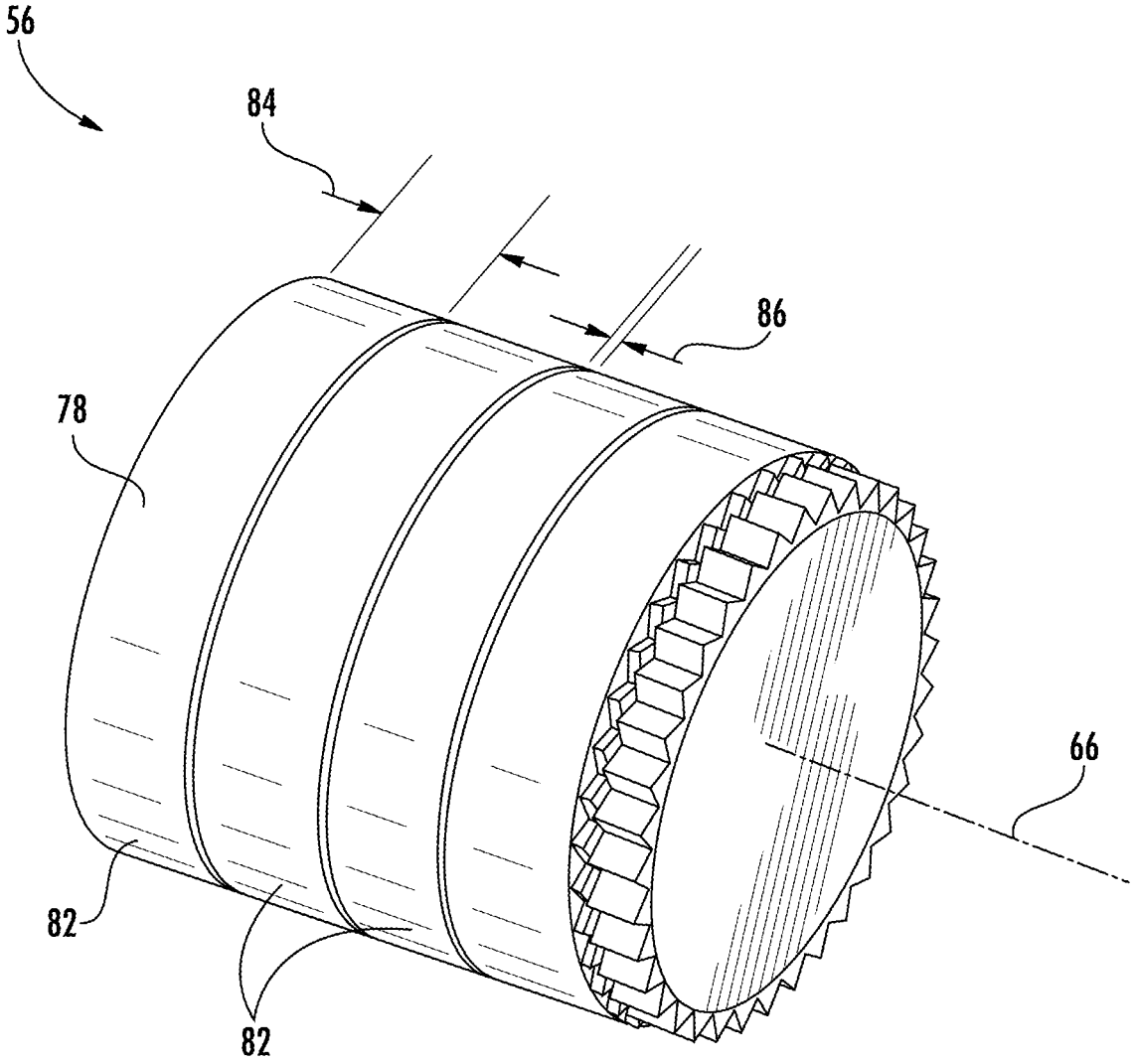
FIG. 8 is a cross-sectional view of still another embodiment of a heat exchanger tube.

Another embodiment of heat exchange tube 56 is shown in FIG. 8. In the embodiment of FIG. 8, a segmented porous cover layer 78 is included. The porous cover layer 78 includes a plurality of cover layer segments 82 arranged axially along the tube axis 66. The cover layer segments 82 each have an axial segment length 84 and an axial cover layer spacing 86 between adjacent cover layer segments 82. In some embodiments, a ratio of cover layer spacing 86 to segment length 84 is less than 1. It is to be appreciated that while in the embodiment of FIG. 8, the segment lengths 84 are substantially equal and the layer spacing 86 is substantially equal between the cover layer segments 82, in other embodiments, the segment lengths 84 and/or the layer spacing 86 may vary along the tube length and/or circumferentially around the heat exchange tube 56 to obtain selected thermal exchange properties. Further, in some embodiments the porous cover layer 78 may be segmented in a circumferential direction as an alternative to, or in addition to the axial segmentation illustrated in FIG. 8.

The porous cover layers 78 may be formed integrally with the high porosity regions 60 and low porosity regions 64, or may alternatively be added during a secondary operation after application of the high porosity regions 60 and low porosity regions 64 to the heat exchange tube 56. The porous cover layers 78 may be added to the high porosity regions 60 and low porosity regions 64 via, for example, brazing, or by additive manufacturing processes including, but not limited to selective layer sintering.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A heat exchanger for a heating ventilation, air conditioning and refrigeration (HVAC/R) system comprising:

a heat exchanger housing; and a plurality of heat exchanger tubes extending through the heat exchanger housing, the plurality of heat exchanger tubes conveying a first fluid therethrough for thermal energy exchange with a second fluid outside of the plurality of heat exchanger tubes, each heat exchanger tube of the plurality of heat exchanger tubes including:

a tube inner surface; and a tube outer surface radially offset from the tube inner surface, the tube outer surface including patterned porosity with a plurality of high porosity regions of the tube outer surface having relatively high porosity to promote flow of the second fluid radially inwardly via capillary flow, and a plurality of low porosity regions of the tube outer surface having relatively low porosity to facilitate vapor departure from the tube outer surface;

wherein the plurality of high porosity regions and the plurality of low porosity regions are arranged about a circumference of the tube outer surface in a circumferentially alternating arrangement of a high porosity region of the plurality of high porosity regions and a low porosity region of the plurality of low porosity regions; and wherein the plurality of high porosity regions and the plurality of low porosity regions alternate radially in a circumferential direction about the tube;

wherein the plurality of high porosity regions and the plurality of low porosity regions are arranged in a plurality of rows along a tube axis, and wherein each high porosity region of the plurality of high porosity regions has a circumferential center, and wherein a circumferential center of each high porosity region of the plurality of high porosity regions in a first row of the plurality of rows is located angularly offset relative to the tube axis from a circumferential center of each high porosity region of the plurality of high porosity regions of an axially adjacent second row of the plurality of rows.

2. The heat exchanger of claim 1, wherein the low porosity regions are defined by spaces between adjacent high porosity regions of the plurality of high porosity regions.

3. The heat exchanger of claim 1, wherein a high porosity region of the plurality of high porosity regions has a triangular cross-sectional shape.

4. The heat exchanger of claim 1, wherein a ratio of an axial length of a high porosity region of the plurality of high porosity regions along a tube axis to a radial height of the high porosity region of the plurality of high porosity regions is between about 0.1 and 10.0.

5. The heat exchanger of claim 1, further comprising a cylindrical porous cover layer disposed radially outboard of the tube outer surface and over the plurality of high porosity regions and the plurality of low porosity regions, the porous cover layer extending circumferentially around the tube.

6. The heat exchanger of claim 5, wherein the porous cover layer comprises a plurality of cover layer segments with an axial cover layer gap between axially adjacent cover layer segments of the plurality of cover layer segments.

7. The heat exchanger of claim 1, wherein the plurality of high porosity regions are formed from a plurality of microspheres.

* * * * *